343-700 MS AU 251 EX
3/1/87 OR 4,691,206

United States Patent [19]

Shapter et al.

[11] Patent Number: 4,691,206

[45] Date of Patent: Sep. 1, 1987

[54] MICROSTRIP AND CAVITY-BACKED APERTURE ANTENNA

[75] Inventors: Hugh Shapter, Funtington; Colin Wood, Havant, both of England

[73] Assignee: Plessey Overseas Limited, Ilford, England

[21] Appl. No.: 720,405

[22] Filed: Apr. 5, 1985

[30] Foreign Application Priority Data

Apr. 11, 1984 [GB] United Kingdom ..... 8409339

[51] Int. Cl.[4] ..... H01Q 1/38; H01Q 13/18

[52] U.S. Cl. ..... 343/700 MS; 343/725; 343/771

[58] Field of Search ..... 343/700 MS File, 725, 343/770, 771, 789, 729, 893, 767, 829, 846

[56] References Cited

U.S. PATENT DOCUMENTS 4,060,810 11/1977 Kerr et al. ..... 343/725

4,180,817 12/1979 Sanford ..... 343/700 MS 4,369,447 1/1983 Edney ..... 343/700 MS

*Primary Examiner*—William L. Sikes

*Assistant Examiner*—Michael C. Wimer

*Attorney, Agent, or Firm*—Fleit, Jacobson, Cohn & Price

[57] ABSTRACT

A microwave antenna comprising a dielectric substrate, carrying on one side thereof a microstrip antenna suitable for operation within a first frequency band and on the other side thereof a conductive ground plane, a first microwave feed coupled between the microstrip antenna and the ground plane for conducting microwave signals in the first band, at least one radiation aperture formed in the ground plane for operation within a second frequency band and arranged to communicate with a resonant microwave cavity defined between the ground plane and a conductive enclosure arranged to extend therefrom, and a second microwave signal feed coupled between the ground plane and the said enclosure for conducting microwave signals in the second band.

8 Claims, 5 Drawing Figures

MICROSTRIP AND CAVITY-BACKED APERTURE ANTENNA

This invention relates to microwave antennas and more especially it relates to dual frequency microwave antennas.

It is an object of the present invention to provide a dual frequency microwave antenna capable of operation at two widely spaced and unrelated microwave frequencies whereby for example, X band signals can be transmitted and L or D band signals can be received contemporaneously.

According to the present invention a microwave antenna comprises a dielectric substrate, carrying on one side thereof a microstrip antenna suitable for operation within a first frequency band and on the other side thereof a conductive ground plane, a first microwave feed coupled between the microstrip antenna and the ground plane for conducting microwave signals in the first band, at least one radiation aperture formed in the ground plane for operation within a second frequency band and arranged to communicate with a resonant microwave cavity defined between the ground plane and a conductive enclosure arranged to extend therefrom, and a second microwave signal feed coupled between the ground plane and the said enclosure for conducting microwave signals in the second band.

The microstrip antenna may comprise a plurality of microstrip patches.

The microstrip patches may comprise a plurality of similar equispaced rows of serially connected microstrip patches, the rows being fed in parallel from the said first microwave feed.

The radiation aperture or apertures may comprise an elongate slot or slots.

Two resonant rectilinear microwave cavities may be provided each having two elongate slots in communication therewith.

The resonant rectilinear microwave cavities may be rectangular in cross section in planes parallel with the ground plane and the slots of each cavity may be arranged to be mutually parallel and to extend along opposite edges of the rectilinear cavities.

The microwave cavity or cavities may be filled with a dielectric material.

The microwave cavity or cavities may have walls formed by a metallic coating or covering formed on the dielectric filling material.

The first microwave feed may be arranged to feed the microstrip antenna at two locations.

The second microwave feed may be arranged to feed each microwave cavity via a microwave splitter/combiner.

The microstrip antenna may be used for the transmission of signals at X-band and the radiation aperture or apertures may be used for the reception of signals at L or D-band.

The microwave antenna may form a part of an interrogator for use in a transponder/interrogator system.

Some embodiments of the invention will now be described solely by way of example with reference to the accompanying drawings in which.

Figure 1:
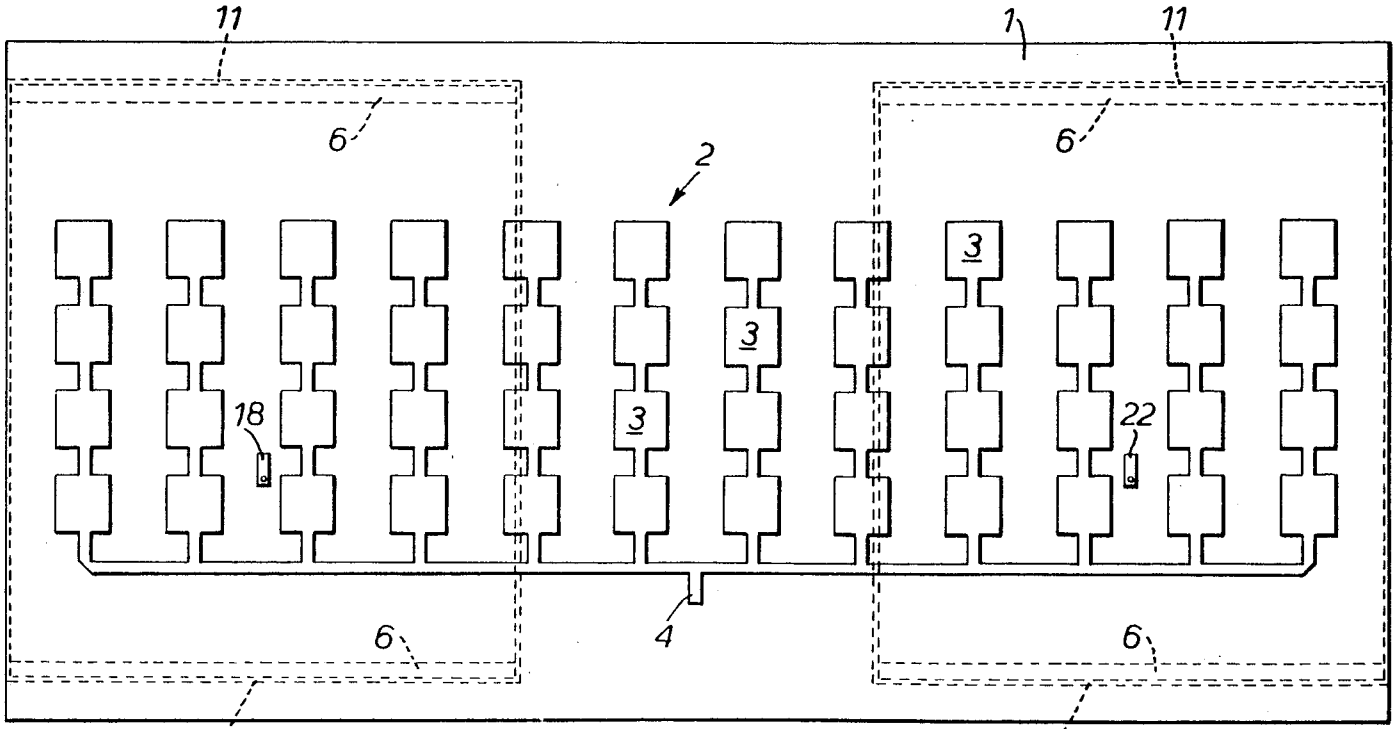
FIG. 1 is a plan view of a dual frequency microwave antenna.
Figure 2:
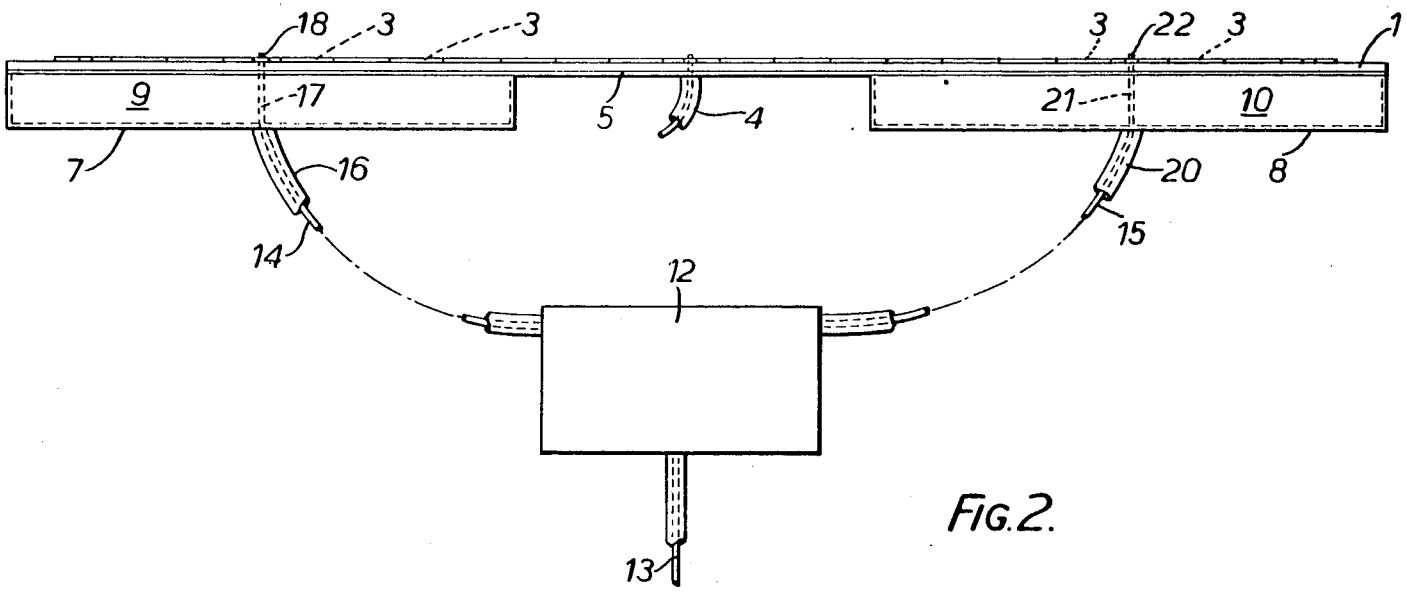
FIG. 2 is a side view of the microwave antenna shown in FIG. 1.

Referring now to the drawings, wherein corresponding parts of the various figures bear the same numerical designations a microwave antenna comprises a low loss dielectric substrate 1 which carries on one side a microstrip antenna 2. The microstrip antenna 2 comprises a plurality of microstrip patches 3 arranged in serially connected rows to define a co-ordinate array. The rows of microstrip patches 3 are fed in parallel from a first microstrip feed 4. Although in the present example the microstrip 4 is arranged to feed the patches at a single location, in an alternative embodiment the microstrip feed may be arranged to feed the rows with signals injected at two different points whereby suitable phasing of the microwave input signals is achieved.

Figure 3:
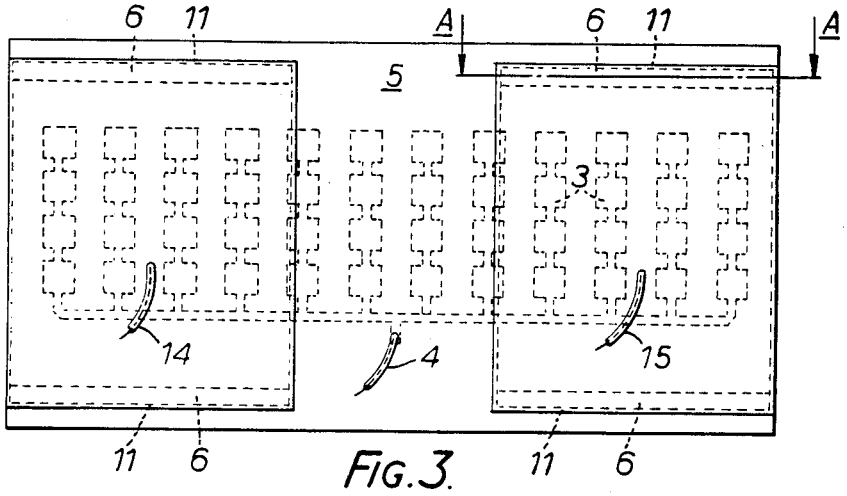
FIG. 3 is a plan view of the underside of the microwave antenna shown in FIG. 1.
Figure 4:
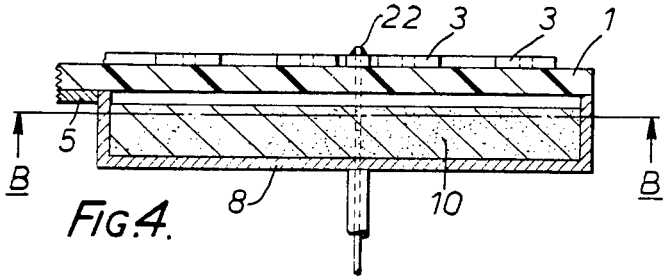
FIG. 4 is a part sectional side view of a part of the microwave antenna shown in FIG. 1, FIG. 2 and FIG. 3.
Figure 5:
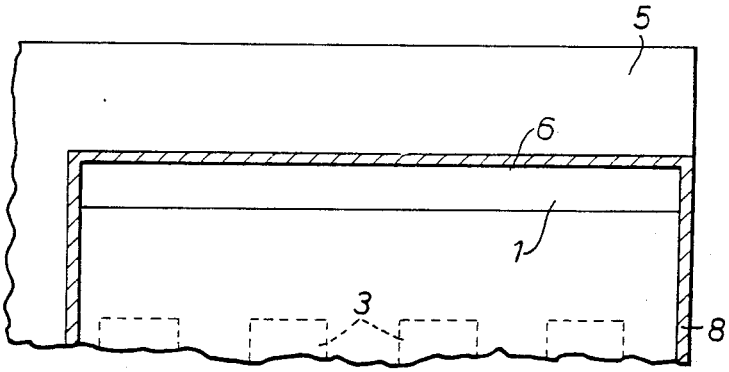
FIG. 5 is a sectional view on a line B—B shown in FIG. 4 of the part of the microwave antenna shown in FIG. 4.

The substrate 1 is arranged to carry on the side opposite to the microwave antenna 2 a conductive ground plane 5 as shown most clearly in FIG. 3. Radiation apertures comprising elongate slots 6 are formed in the ground plane and two conductive enclosures 7 and 8 are arranged to be upstanding from the ground plane so as to define microwave cavities 9 and 10 respectively. The radiation slots 6 are arranged to communicate with the cavities 9 and 10, the conductive enclosures 7 and 8 which define the cavities being arranged to be rectilinear and each to include two mutually parallel slots which extend along opposing edges 11. The cavities 9 and 10 are fed via a microwave splitter/combiner 12 from a coaxial feed 13, coaxial input feeds 14 and 15 being fed to the cavities 9 and 10 respectively from the splitter/combiner 12. The coaxial input feed 14 is connected so that its outer conductor 16 is coupled to a wall of the enclosure 7 and so that its inner conductor 17 extends through the ground plane 5 to be terminated on a capacitive coupling patch 18 which is formed on the substrate on the same side as the patches 3. Similarly, the coaxial input feed 15 comprises an outer conductor 20 which is connected to a conductive wall of the enclosure 8 and an inner conductor 21 which is terminated at a capacitive coupling patch 22 formed on the surface of the substrate 1 on the same side as the microstrip patches 3. The inner conductors 17 and 21 thus do not make contact with the ground plane 5 and pass through the substrate 1 to make contact with their respective capacitive coupling patches 18 and 22.

The microstrip patches 3 of the microstrip antenna 2 and the slots in the ground plane may be formed by any conventional printed circuit technique and conductive parts are defined by copper conductive material carried on opposing sides of the substrate. The conductive enclosures 7 and 8 may be formed by conductive material which is laid down on dielectric material which fills the cavities 9 and 10, the conductive walls of the enclosures being arranged to make good conductive contact with the ground plane 5.

Although in the present example microwave signals are fed to the cavities 9 and 10 from the ground plane side of the substrate in an alternaive embodiment the signals may be initially fed through the substrate by a microwave feed and then carried by printed circuit conductors to enter the cavity from the microstrip patch side of the substrate.

The microwave antenna just before described finds particular application in the interrogator of a transponder interrogator system and the microstrip antenna, are in this case, used for the transmission of directive microwave signals and the slots are arranged to receive microwave return signals. In this particular example the signals are transmitted from the microwave microstrip antenna in the X-band and D or L-band transponder signals are received through the slots.

By providing a microwave antenna of the kind just before described, a particularly compact and convenient structure is afforded which is capable of operating at two widely spaced and unrelated microwave frequencies.

We claim:

1. A microwave antenna comprising a dielectric substrate, carrying on one side thereof a microstrip antenna defined by a plurality of microstrip patches, said antenna being suitable for operation within a first frequency band and carrying on the other side thereof a conductive ground plane, a first microwave feed coupled between the microstrip antenna and the ground plane for conducting microwave signals in the first band, at least one radiation aperture formed in the ground plane for operation within a second frequency band and arranged to communicate with an otherwise closed resonant microwave cavity defined between the ground plane and a conductive enclosure arranged to extend therefrom, and a second microwave feed coupled to conductor means carried on the substrate on a side thereof remote from the ground plane, the conductor means being arranged to extend into the enclosure to feed microwave signals in the second band from the second microwave feed to the resonant microwave cavity.

2. A microwave antenna as claimed in claim 1 wherein the microstrip patches comprise a plurality of similar equispaced rows of serially connected microstrip patches, the rows being fed in parallel from the said first microwave feed.

3. A microwave antenna as claimed in claim 2, wherein the aperture comprises an elongate slot.

4. A microwave antenna as claimed in claim 3, comprising two resonant rectilinear microwave cavities each having two elongate slots in communication therewith, the slots being defined by mutually parallel apertures in the ground plane.

5. A microwave antenna as claimed in claim 4, wherein the microwave cavities are filled with a dielectric material.

6. A microwave antenna as claimed in claim 5, wherein the microwave cavities are arranged to have walls formed by a metallic coating or covering formed on the dielectric filling material.

7. A microwave antenna as claimed in claim 6, wherein the second microwave signal feed is arranged to feed each microwave cavity via a microwave splitter/combiner.

8. A microwave antenna as claimed in claim 2, wherein the conductor means comprises coupling patches carried on the substrate along with but spaced apart from the plurality of microstrip patches, to serve as anchor points for inner conductors of a coaxial microwave feed which defines the second microwave feed and which is arranged to extend into the enclosure from the ground plane side thereof.

* * * * *